United States Patent [19]

Globig

[11] 4,315,120

[45] Feb. 9, 1982

[54] LOAD DISCONNECTION SWITCH

[75] Inventor: Manfred Globig, Filderstadt, Fed. Rep. of Germany

[73] Assignee: Concordia Sprecher Schaltgerate GmbH, Fed. Rep. of Germany

[21] Appl. No.: 71,909

[22] Filed: Sep. 4, 1979

[30] Foreign Application Priority Data

Feb. 27, 1979 [DE] Fed. Rep. of Germany ..... 2907574

[51] Int. Cl.[3] ..... H01H 33/04

[52] U.S. Cl. ..... 200/146 R; 200/77; 200/62

[58] Field of Search ..... 200/146 R, 77, 62

[56] References Cited

U.S. PATENT DOCUMENTS

| | | | |
|---|---|---|---|
| 2,272,717 | 2/1942 | Ludwig et al. | 200/146 R |
| 2,785,254 | 3/1957 | Atkinson | 200/62 |
| 2,848,575 | 8/1958 | Hahn, Jr. | 200/77 |
| 2,883,493 | 4/1959 | Stoelting | 200/62 |
| 3,564,174 | 2/1971 | Clarke | 200/77 |
| 3,876,849 | 4/1975 | Jackson, Jr. | 200/146 R |

FOREIGN PATENT DOCUMENTS

| | | | |
|---|---|---|---|
| 693775 | 7/1940 | Fed. Rep. of Germany | 200/77 |
| 1203340 | 9/1958 | France | 200/77 |

*Primary Examiner*—Robert S. Macon

*Attorney, Agent, or Firm*—Townsend and Townsend

[57] ABSTRACT

A load disconnection switch incorporating a quench chamber is described which features a tube-like housing, a telescope-like arrangement of a quench tube and a switch rod guided for relative axial movement within the tube-like housing and releasably connected together by a coupling system the release of which is dependent on relative movement between the quench tube and the housing.

The coupling system comprises at least one blocking device which is displaceably arranged in a respective radial guide in the wall of the quench tube and which engages in a recess provided in the switch rod. A control wall restricts the radial movement of the blocking device until, after a specified degree of relative movement between the tube-like housing and the coupled arrangement of quench tube and switch rod the restraint provided by the control wall is lifted and the ensuing relative movement of the quench tube and switch rod results in the current carrying path through the switch rod being interrupted at a spark contact and the heat generated at the spark contact causes the omission of quench gas from an associated quench rod which promptly extinguishes the arc.

The spark contact is conveniently guided in an opening in the wall of the quench tube and a diametrically opposed pressure pad located at the other side of the switch rod ensures contact between the switch rod and the spark contact.

15 Claims, 1 Drawing Figure

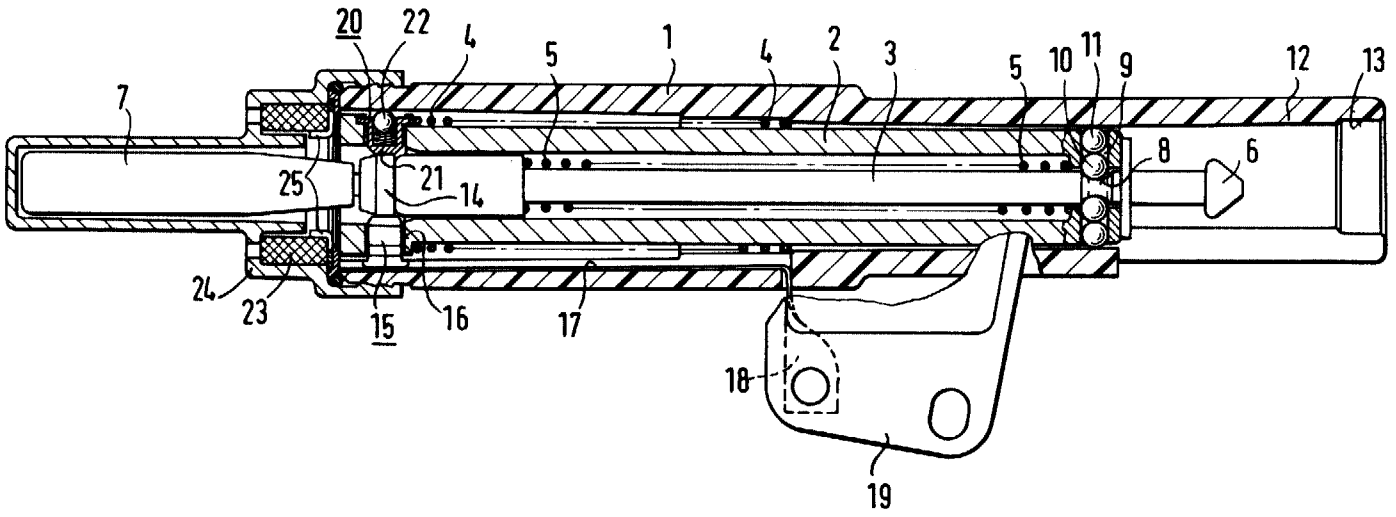
13
12
6
8
9
11
10
5
3
2
4
1
5
4
22
20
7
24
23
25
21
14
16
15
17
18
19

LOAD DISCONNECTION SWITCH

The invention relates to a load disconnection switch incorporating a quench chamber and has particular reference to a load disconnection switch of the kind which is often connected in parallel with a main switch.

In arrangements of this kind two parallel current paths are defined by the main switch and the load disconnection switch with the major portion of the current flowing through the main switch. When it is desired to disconnect the current supply the main switch can be disconnected without arcing and the load disconnection switch is subsequently disconnected and enables the ensuing arc to be quenched by the associated quench chamber.

A typical load disconnection switch features a tube-like housing with a telescope-like arrangement of a quench tube and a switch rod guided for relative axial movement within the tube-like housing and releasably connected together by a coupling system the release of which is dependent on the relative movement between the quench tube and the housing.

Load disconnection switches of this kind are generally known and are in practice extensively used. In the known load disconnection switches the releasable coupling system the release of which is dependent on relative movement between the quench tube and the housing is in the form of a spring biased pawl arrangement which cooperates with inclined surfaces or cams. A reliable and trouble-free operation is required of these coupling systems as faulty switching can only be avoided if the point or time at which the disconnection takes place is ensured with great accuracy. It is particularly critical that a premature release of the coupling system be avoided because if this occurs the required gap in the main current path through the main switch is not ensured and arcing can result which severely damages the main switch.

For the known load disconnection switches the provision of a defined release point for the coupling system is particulary critical because a number of factors effect the adjustment of the release point. These factors include the characteristics of the springs that are used, the accuracy of the various grooves or cams and, furthermore, e.g. during manufacture or also in later operation the formation of burrs or wear can pronouncedly and disadvantageously affect the manner of operation. As it is very difficult to control the above factors it is also very difficult to ensure a timely release of the coupling system, particularly to ensure satisfactory long term operation.

The principal object of the present invention is to so construct a load disconnection switch and associated quench chamber of the type set out above that, whilst simultaneously simplifying the construction, the danger of faulty switching, in particular due to early release of the coupling system between the quench tube and the switch rod, is substantially avoided.

This object is solved in accordance with the present teaching by a load disconnection switch incorporating a quench chamber and comprising a tube-like housing, a telescope-like arrangement of a quench tube and a switch rod guided for relative axial movement within the tube-like housing and releasably connected together by a coupling system the release of which is dependent on relative movement between the quench tube and the housing and wherein the coupling system comprises at least one blocking device displaceably arranged in a radial guide of the quench tube, a recess provided in the switch rod and into which the blocking device is engageable to effect coupling between the quench tube and the switch rod, and a control wall of insulating material which limits the extent of radial movement of the blocking device and wherein the control wall has, at a location corresponding to the end of a predetermined initial relative movement between the quench tube and the tube-like housing an increase in cross-section which corresponds at least to the engagement depth of the blocking device in the recess whereby to allow decoupling of the quench tube and switch rod.

In this way it is ensured that the time at which the coupling system releases can be exactly predetermined independently of the prevailing bias springs. Furthermore, because the principle on which the release is based does not depend on a pawl mechanism the actuation of the load disconnection and quench chamber mechanism is possible without jerking or jolting which would otherwise disadvantageously effect the operation of the load disconnection switch.

The recess is conveniently and preferably formed as an annular groove on the switch rod.

It is particularly advantageous to use balls, i.e. spherical ball bearings, as the blocking devices and usefully a plurality of blocking devices are provided each comprising a pair of balls arranged in a respective radial guide in the quench tube. The radial guide is simply formed as a radially directed bore.

The use of balls results in an extremely economical arrangement, leads to low frictional values, precludes any form of damage to critical edges and results in a compact construction.

The side walls of the annular groove and also the transition at the said location on the control wall to the region of increased cross-section are preferably formed as inclined surfaces which favourably influence the trouble-free and jerkless actuation of the disconnection and quench processes. The high operational reliability that is achieved in this way makes it possible to forego the previously customary trouble of checking on the accuracy of the time of release.

A particularly advantageous form for a load disconnection switch and associated quench chamber which although preferably used in connection with the special coupling system can also be used independently thereof features a tube-like housing of insulating material in which at least one current carrying track is provided on the inner wall of the housing along a corresponding generatrix thereof and that a spark contact guided in an opening in the quench wall is arranged between the current carrying track and a contact on the switch rod.

The use of a housing formed in a synthetical plastic tube is above all advantageous because, in comparison to the customary housings for quench chambers, the voltage at which glow discharge starts is somewhat higher and smaller distances with respect to earth or other voltage carrying components are possible.

The current carrying track, which preferably comprises a spring, in particular a leaf spring, or a wire is simple and economical to construct and satisfies its associated tasks without trouble because it is only subjected to high currents, e.g. currents of around 600 A over a few milliseconds.

A further significant feature of the invention is that a spring bias pressure pad which is likewise guided in a diametrically oppositely disposed opening of the quench tube is associated with the spark contact and this pressure pad is usefully of cap-like form and can be biased radially inwardly by means of a spring provided in an inner space of the cap and braced via a ball against the tube-like housing.

The separation of the functions of creating the contact pressure and the carrying of current brings particular practical advantages.

A longitudinal guide groove is preferably associated with the ball of the pressure pad which ensures that a rotation of the quench tube is precluded.

The construction of the quench tube in accordance with the invention thus brings about an increase in operational reliability, a significant saving of weight and, in comparison with previous load disconnection switches is significantly more economical to manufacture.

An embodiment of the invention will now be described in the following by way of example only and with reference to the single drawing which illustrates a longitudinal section through a load disconnection switch and associated quench chamber with the telescope-like arrangement of quench tube and switch rod in the retracted condition.

As seen in the drawing the load disconnection switch comprises a tube-like housing 1, a quench tube 2 arranged within the housing and a switch rod 3 arranged in telescope-like form within the quench tube. A spring 4 is arranged between the housing 1 and the quench tube 2 and a further spring 5 is provided between the switch rod 3 and the quench tube 2. These springs 4 and 5 bias the quench tube and switch rod towards the illustrated retracted position. The switch rod 3 is provided in a customary manner with a switch rod head 6 which cooperates with a pair of switch blades which are not shown but which form a part of a conventional main switch assembly and which are operative to pull the switch rod head 6 in the axial direction towards the right as seen in the drawing. The other end of the switch rod 3 is provided with a quench rod 7 formed of a plastic material which when heated generates a quench gas.

The quench tube 2 and switch rod 3 are coupled together by a coupling system which features a coupling groove or recess 8 provided on the switch 3 in the vicinity of its head end, in which balls 10 forming parts of blocking devices can engage. In the arrangement shown two blocking devices can be seen and each comprises a pair 10, 11 of balls displaceably arranged in a respective radial guide bore 9 in the wall of the quench tube.

In practice a single ball in a single radial guide is sufficient for the purposes of the invention but in the interests of symmetry it is preferred that at least two diametrically opposed blocking devices are provided and for reasons of size that each blocking device comprises a pair of balls disposed in a respective radial guide.

In the illustrated embodiment the outer ball 11 of each pair of balls 10 and 11 abuts on a control wall 12 which is formed by a partial sleeve-like extension of the tube-like housing 1. The housing 1 and its extension are made in synthetic or plastic material. It will be seen that the lower portion of the control wall is cut away and this has being done simply to provide adequate access for the switch blades which draw the switch head 6 to the right.

Because of the presence of this cut-out it can be advantageous to provide three blocking devices which are equispaced with the cut-out from the tube-like wall located between a pair of blocking devices.

The control wall 12 prevents radial movement of the balls 10 and 11 over a specified distance of relative movement between the tube-like housing and the coupled arrangement of quench tube and switch rod. In this way it is ensured that the relative position of the quench tube 2 and switch rod 3 remains constant, i.e. that they are positively coupled together. In the zone of the free end of the partial sleeve-like control wall 12 there is provided an increase in cross-section 13 and this increase in cross-section makes it possible for the balls 10 and 11 to move radially outwardly and this is associated with the decoupling of the connection between the quench tube 2 and the switch rod 3.

The control wall 12 projects in practice into the main switch region but this brings the advantage that a separating plate introduced into the switch region can be brought into abutment on the control wall 12 which is of insulating material and does not directly need to contact parts which are carrying voltages.

The current path via the switch rod 3 includes the contact ring 14 which belongs to the switch rod 3, a spark contact which contacts the contact ring and is guided in an opening 16 of the quench tube 2 and also a current carrying track 17 which is arranged substantially along a generatrix of the tube-like inner wall of the housing 2 and which leads to a connection terminal 18 on a clip 19 which is used to secure the load disconnection switch and its associated quench chamber into the switch installation.

The current carrying track 17 can be formed as a spring, in particular as a leaf spring, or as a wire.

The contact pressure between the spark contact 15 and the contacting ring 14 is ensured by means of a separate pressure pad unit which is arranged diametrically opposite to the spark contact 15. The pressure pad unit comprises a cap-like element 20 which is guided in an opening in the quench tube 2 and which has a compression coil spring 21 arranged in an internal space which is braced against the internal wall of the housing via a ball 22. Both the pressure pad element and also the spark contact are so contructed that they can be held by their respective radially outwardly disposed end regions on the quench tube wall, e.g. by means of respective lips and cannot fall inwardly.

At the gas outlet region from the quench chamber there is arranged a metal grid or mesh 23 of non-rusting material and this cooling grid is held within a cap 24 by means of a star-like cover element 25 the bent round lugs of which prevent burnt particles of the metal grid from falling into the quench chamber. Fusing of these metal grid particles with the lugs of the cover element of the support is not disadvantageous.

The manner of operation of the load disconnection switch and associated quench chamber corresponds in general with the manner of operation of the known quench chambers of this kind. Thus the switch rod 3 is first of all drawn to the right and the quench tube 2 follows this movement because of the coupling provided by the coupling system 8, 9, 10, 11. During this movement the spring 4 is compressed. During this movement the current flows over the described current path and after the predetermined amount of relative movement has taken place the coupling system between the coupling tube 2 and the switch rod 3 disengages as the balls 11 have moved into the portion of enlarged cross-section 13. At exactly this moment in which the balls 10 and 11 of the blocking devices are thrust radially outwardly the current path in the quench tube is broken as the switch rod 3 continues to move forwardly thus breaking the contact between the contact ring 14 and the spark contact 15. The breaking of the contact between the spark contact 15 and the contact ring 14 defines the moment at which the switch has been disconnected and the ensuing arc generates heat which causes a quench gas to be released from the synthetic material of the quench rod 7. The quench gas then in turn quenches the arc and the hot pressurized gas escapes via the metal grid 23.

After the quench procedure has finished and after the switch knives have disengaged from the switch head 6-by virtue of the separating blade-the switch rod 2 is once more returned via the spring 5 and the entire device once more returns to the illustrated initial position in which the coupling system couples the quench tube and switch rod.

The side walls of the groove 8 and the step at the transition to the portion 13 of enlarged cross-section are provided with inclined faces which cooperate with the curved surfaces of the balls to ensure smooth operation of the switch.

It will be apparent for those skilled in the art that various modifications are possible to the arrangement shown in the drawings without departing from the scope of the present teaching.

In particular it will be understood that although the load disconnection switch has been described as incorporated in parallel with a main switch it can equally be used on its own. In this case switching is once more initiated by drawing the switch rod axially to the right.

I claim:

1. A load disconnection switch incorporating a quench chamber and comprising a tube-like housing, a telescope-like arrangement of a quench tube and a switch rod guided for relative axial movement within the tube-like housing and releasably connected together by a coupling system the release of which is dependent on relative movement between the quench tube and the housing and wherein the coupling system comprises at least one blocking device displaceably arranged in a radial guide of the quench tube, a recess provided in the switch rod and into which the blocking device is engageable to effect coupling between the quench tube and the switch rod, and a control wall of insulating material which limits the extent of radial movement of the blocking device and wherein the control wall has, at a location corresponding to the end of a predetermined initial relative movement between the quench tube and the tube-like housing an increase in cross-section which corresponds at least to the engagement depth of the blocking device in the recess whereby to allow decoupling of the quench tube and switch rod.

2. A load disconnection switch in accordance with claim 1 and wherein said recess comprises an annular groove.

3. A load disconnection switch in accordance with claim 2 and wherein at least two diametrically oppositely disposed balls arranged in respective radial guides define respective blocking devices.

4. A load disconnection switch in accordance with claim 2 and in which said at least one blocking device is defined by a pair of balls arranged in a bore defining said respective radial guide.

5. A load disconnection switch in accordance with claim 2 and wherein a plurality of blocking devices are provided each said blocking device being defined by a pair of balls arranged in an associated radial guide said associated radial guides being defined by bores in the quench tube.

6. A load disconnection switch according to claim 2 and wherein both the side walls of said groove and the transition at said location on the control wall to an increased cross-section are defined by inclined surfaces.

7. A load disconnection switch in accordance with claim 2 and wherein a plurality of blocking devices are provided each blocking device incorporating at least one ball and wherein the width of said groove in the axial direction of the switch rod is wider than the diameter of the balls.

8. A load disconnection switch in accordance with claim 2 and in which the tube-like housing is of insulating material and simultaneously defines said control wall, the control wall being formed by a partial sleeve-like extension of the tube-like housing.

9. A load disconnection switch in accordance with claim 1 and wherein the tube-like housing is formed of insulating material and at least one current conducting path is provided on the internal wall of the housing along a corresponding generatrix thereof and that a spark contact guided in an opening in the quench tube is arranged between the current conducting path and a contact on the switch rod.

10. A load disconnection switch in accordance with claim 9 and wherein a spring biased pressure pad, which is likewise guided in a diametrically oppositely disposed opening in the quench tube, is associated with the spark contact.

11. A load disconnection switch in accordance with claim 10 and wherein said pressure pad is of cap-like form and is radially biased inwardly by means of a spring provided in an internal space in the cap and a ball which is braced on said tube-like housing.

12. A load disconnection switch in accordance with claim 11 and wherein a longitudinal guide groove in the internal wall of said tube-like housing is associated with said ball.

13. A load disconnection switch in accordance with claim 9 and wherein the current conducting path is defined by a spring.

14. A load disconnection switch in accordance with claim 13 and wherein said spring is a leaf spring.

15. A load disconnection switch in accordance with claim 9 and wherein said current conducting path is defined by a wire.

* * * * *